US007202821B2

(12) United States Patent
Fujikawa et al.

(10) Patent No.: US 7,202,821 B2
(45) Date of Patent: Apr. 10, 2007

(54) ANTENNA

(75) Inventors: Kazuhiko Fujikawa, Kyotanabe (JP); Susumu Inatsugu, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 9 days.

(21) Appl. No.: 11/152,616

(22) Filed: Jun. 14, 2005

(65) Prior Publication Data

US 2005/0280588 A1 Dec. 22, 2005

(30) Foreign Application Priority Data

Jun. 18, 2004 (JP) ..... 2004-181026

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 6,724,347 B2 * 4/2004 Satoh et al. ..... 343/700 MS
6,894,646 B2 * 5/2005 Washiro et al. ..... 343/700 MS
7,055,754 B2 * 6/2006 Forster ..... 235/492
2004/0119593 A1 * 6/2004 Kuhns ..... 340/572.7
2004/0263407 A1 12/2004 Inatsugu et al.
2006/0082505 A1 * 4/2006 Baliarda et al. ..... 343/700 MS

FOREIGN PATENT DOCUMENTS

JP 62-122401 A 6/1987

* cited by examiner

*Primary Examiner*—Tan Ho
*Assistant Examiner*—Dieu Hien Duong
(74) *Attorney, Agent, or Firm*—RatnerPrestia

(57) ABSTRACT

On the top surface of conductive ground plate, first holder having first antenna element, second holder having second antenna element, and support having parasitic antenna element are provided such that holders and support confront each other. Respective intermediate sections of antenna elements are folded to shape like "square C" in plural times, so that antenna is formed. The foregoing construction allows low-profiling and downsizing antennas to be used in mobile radio devices.

8 Claims, 5 Drawing Sheets

ANTENNA

FIELD OF THE INVENTION

The present invention relates to antennas such as mobile antennas to be used in mobile radio devices.

BACKGROUND OF THE INVENTION

Recently, linear mono-pole antennas or folded mono-pole antennas have been used, in general, as mobile antennas for mobile radio devices. Those conventional antennas are described hereinafter with reference to FIGS. 6A and 6B. A conventional mono-pole antenna shown in FIG. 6A comprises planar conductive ground plate (or grand plane) 91 made of copper, power feed point placed at the center of ground plate 91, and antenna element 93 shaped like a wire or a rod and made of copper. Element 93 has a height of "H" in a vertical direction with respect to ground plate 91, and its first end P1 is coupled to power feed point while its second end P2 is open.

FIG. 6B shows a conventional folded mono-pole antenna 100, which includes antenna element 103 shaped like "square C" formed by double-backing a copper wire or a copper rod. Element 103 has a height of "H" vertically with respect to conductive ground plate 91, and is folded at height "H" to form "square C". Element 103 has a first end P1 coupled to power feed point and a second end P2 coupled to ground plate 91.

In the construction discussed above, feed of a high frequency current of an operating frequency from signal source via power feed point 92 to antenna element 93 (103) of antenna 90 (100) excites antenna element 93 (103) for transmission. On the other hand, in the case of reception, a high frequency electromagnetic field of the operating frequency excites antenna element 93 (103) for reception.

Since antenna element 93 of mono-pole antenna 90 has the first end P1 coupled to power feed point 92 and the second end P2 open at the height of "H" vertically from ground plate 91, current (i1) between points "P1" and "P2" and in-phase image current (i1) corresponding to points "P1" and "P2" flow to ground plate 91. As a result, element 93 is excited, thereby radiating radio-wave into the air.

On the other hand, folded mono-pole antenna 100 has element 103 folded into a shape of "square C", so that current (i1) between points "P1" and "P2" and current (i3) between points "P3" and "P4" as well as in-phase image currents (i1, i3) corresponding to points "P1" and "P2" and points "P3" and "P4" flow to ground plate 91. As a result, the impedance of antenna 100 increases, thereby broadening its available frequency band.

A folded antenna is disclosed in, e.g. Japanese Patent Unexamined Publication No. S62-122401.

The foregoing conventional antennas work in a ¼ wavelength mode, so that mechanical height "H" needs to be approx. a ¼ wavelength. For instance, an antenna of car telephones, which use 810 MHz–958 MHz (hereinafter referred to as PDC800) band, needs a height of approx. 83 mm.

If height "H" of an antenna element is shortened to a height lower than a ¼ wavelength of the operating frequency, the antenna impedance becomes smaller and it is difficult to obtain an impedance matching. If the foregoing conventional antenna is placed at a rear tray or a dashboard in a car, the antenna is preferably installed such that element 93 (103) is oriented upward; however, the upward installation allows element 93 (103) to occupy a large space in a height direction. As a result, these types of antennas are obliged to limit a mounting place of the antenna or a design of a car body.

SUMMARY OF THE INVENTION

An antenna of the present invention comprises the following elements:

plural holders standing upright at approx. right angles on a top surface of a conductive ground plate and placed confronting each other at given intervals in between; and a first antenna element and a second antenna element independently disposed on one of top face or rear face of the holders, wherein the first antenna element has its first end coupled to a power feed point, and an intermediate section formed above the ground plate is folded in plural times, wherein the second antenna element has a first end coupled to a second end of the first antenna element, a second end coupled to the ground plate, and an intermediate section formed above the ground plate is folded in plural times. Folding in plural times of the intermediate sections of both the first and the second elements allows overall lengths of respective antenna elements to be a ⅝ wavelength, so that the antenna elements can work in a ¼ wavelength mode. This construction allows the respective antenna elements to be low-profiled, so that a compact antenna is obtainable.

An antenna of the present invention may include a parasitic antenna element of which intermediate section is shaped like that of a first antenna element or a second antenna element. This parasitic antenna element is excited in-phase with the first and the second antenna elements, so that the antenna can broaden its frequency band.

An antenna of the present invention may include holders and supports made of a dielectric substrate. A first antenna element or a second antenna element is formed into a predetermined pattern on the dielectric substrate. The printed wiring boards can form the holders and the supports, and the metal layer of the printed wiring board can form the first, second, and parasitic antenna elements. As a result, a high precision antenna can be formed at an inexpensive cost. And according to requested antenna performance, an antenna having various patterns can be easily manufactured.

An antenna of the present invention may include holders and supports made from sheet boards. The holders, first and second antenna elements as well as the supports and parasitic antenna elements can be manufactured consecutively like a sheet, so that the antenna is obtainable at an inexpensive cost.

As discussed above, according to the present invention, the intermediate section of respective antenna elements are folded in plural times, thereby lowering the height of the antenna elements. As a result, a compact antenna is obtainable.

DESCRIPTION OF THE INVENTION

Figure 1:
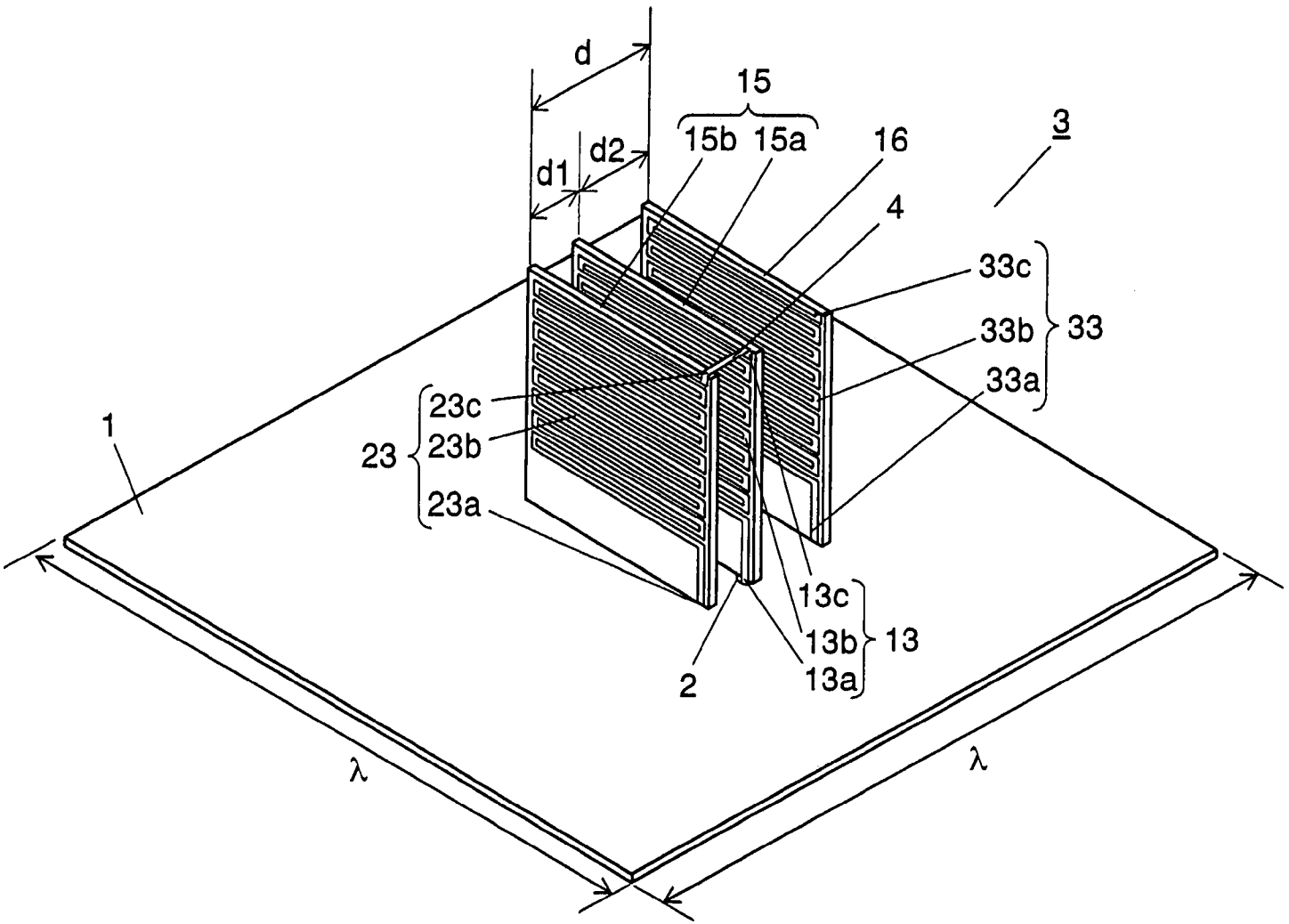
FIG. 1 shows a perspective view of an antenna in accordance with an exemplary embodiment of the present invention.
Figure 2:
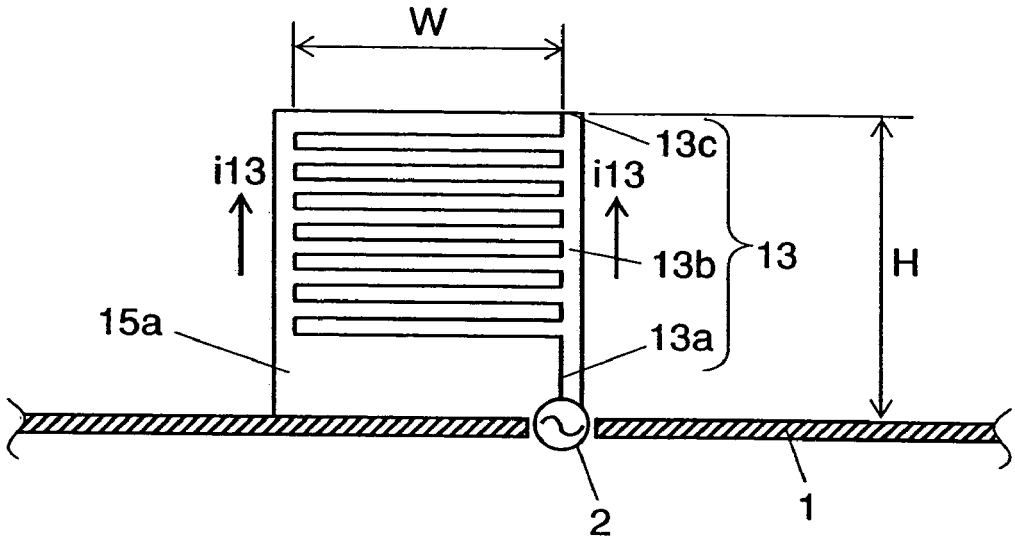
FIG. 2 shows a lateral view of an antenna in accordance with an exemplary embodiment of the present invention.
Figure 3:
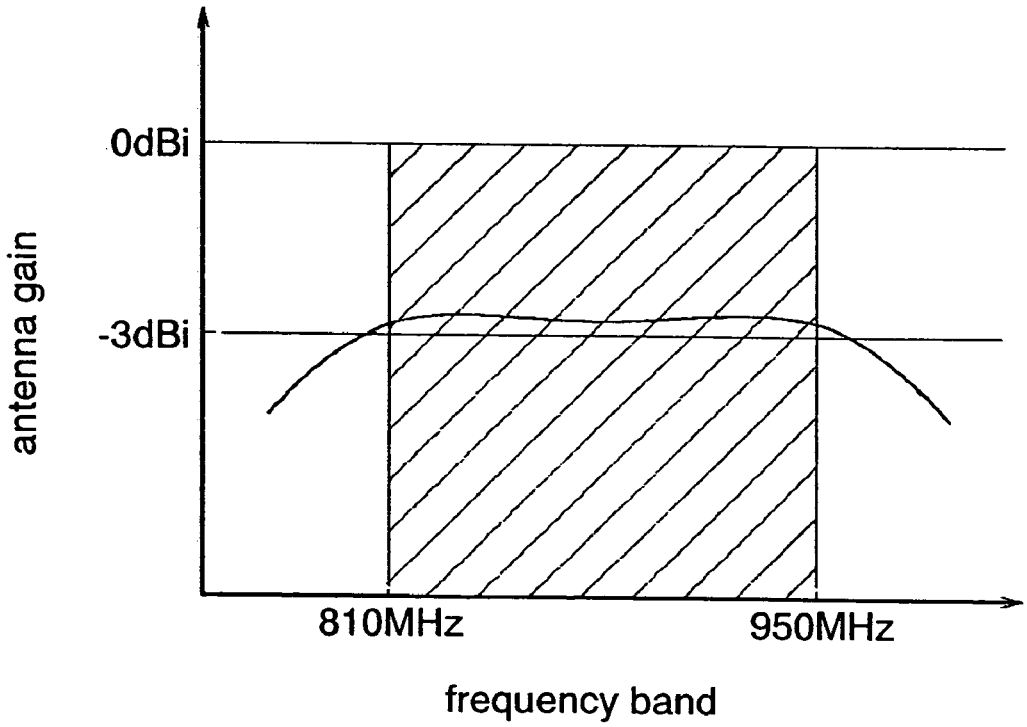
FIG. 3 shows characteristics of an antenna in accordance with an exemplary embodiment of the present invention.

Exemplary embodiments of the present invention are demonstrated hereinafter with reference to FIG. 1–FIG. 5. FIGS. 1 and 2 are schematic diagrams illustrating an antenna in accordance with an exemplary embodiment of the present invention. FIG. 3 shows characteristics of an antenna in accordance with an exemplary embodiment of the present invention.

Antenna 3 includes planar conductive ground plate 1 made of copper and having length and width longer than one wavelength of its operating frequency. Antenna 3 also includes power feed point 2 at an approx. center of ground plate 1 for feeding high-frequency signals.

On the top surface of ground plate 1, first holder 15*a*, second holder 15*b* and support 16 stand approx. upright and confront each other at intervals "d1" and "d2" in between. In the exemplary embodiment, d1=2 (mm) and d2=4 (mm) are selected respectively. However, this invention is not limited to the set of values.

Holders 15*a*, 15*b* and support 16 are formed of a dielectric substrate made from, e.g. ABS (acrylonitrile butadiene styrene) resin, AES (acrylonitrile ethylene styrene) resin, ASA (acrylonitrile styrene acrylate) resin, PP (polypropylene) resin, PS (polystyrene) resin, or epoxy resin.

On the front face of first holder 15*a*, first antenna element 13 made of linear or planar copper is disposed. First antenna element 13 includes first end 13*a* at the right end and intermediate section 13*b*. First end 13*a* is coupled to power feed point 2, and intermediate section 13*b* is folded into a "square C" shape in plural times.

On this side of first holder 15*a*, second holder 15*b* is placed at a given interval. On the front face of second holder 15*b*, second antenna element 23 made of linear or planar copper is disposed. Second end 23*c* at an upper section of second antenna element 23 is coupled to second end 13*c* of first antenna element 13 via junction conductor 4. Intermediate section 23*b* is folded into a "square C" shape in plural times as intermediate section 13*b* of first antenna element 13 is. First end 23*a* at a right end is electrically coupled to ground plate 1.

Support 16 is placed behind first holder 15*a* and includes parasitic antenna element 33 made of linear or planar copper on its front face. Antenna element 33 has first end 33*a* at its right end and intermediate section 33*b* at an upper section. First end 33*a* is coupled to ground plate 1, and intermediate section 33*b* is folded into a "square C" shape in plural times. Element 33 also has second end 33*c* which is left open.

In the antenna shown in FIG. 1, parasitic antenna element 33 confronts first antenna element 13; however, it can confronts second antenna element 23, or two parasitic antenna elements can be provided for confronting respectively first element 13 and second element 23.

In other words, first holder 15*a*, second holder 15*b* and support 16 stand approx. upright and in parallel with each other on ground plate 1. As a result, first antenna element 13, second antenna element 23 and parasitic antenna element 33 confront each other, thereby forming antenna 3.

In the case of transmitting signals from antenna 3 discussed above, power feed point 2 at the center of conductive ground plate 1 feeds high-frequency signals to first antenna element 13 and second antenna element 23, so that high-frequency currents flowing through element 13 and element 23 are excited in-phase. Parasitic antenna element 33 is also exited in phase with elements 13 and 23, so that radio-wave is radiated into the air. In the case of reception, an operation reversal to the transmission discussed above allows receiving signals.

Next, a method of manufacturing antenna 3 in a specific way and a method of testing antenna 3 to be used in PDC800 application are demonstrated hereinafter.

First, press a copper sheet of 0.2 mm thickness, and fold the intermediate section of the copper sheet into "square C" shapes in plural times. Form three antenna elements in this identical shape. Then, mold unitarily each one of the three elements with ABS resin to form an integral antenna element with resin, thereby forming three identical integral antenna elements.

Those three antenna elements integral with resin are described with reference to FIG. 2, which shows only first antenna element 13 because other two elements have a similar structure to that of element 13. First end 13*a* of antenna element 13 is soldered to power feed point 2 which extends through conductive ground plate 1, so that element 3 is electrically coupled to power feed point 2. Intermediate section 13*b* formed at an upper section is folded into "square C" shapes in plural times. The height "H", width "W" and the number of folding of intermediate section 13*b* are set such that the line length until second end 13*c* becomes approx. 5/4 wavelength in order to operate in a 1/4 wavelength mode.

In the exemplary embodiment, as an example, formed antennas have 11 to 14 turns, whose copper sheets has width of 0.4 mm and space between the copper sheets is 0.4 mm The three antenna elements discussed above are placed on the top surface of ground plate 1 such that second antenna element 23, first antenna element 13 and parasitic antenna element 33 are placed in this order from this side to that side and three elements confront each other as shown in FIG. 1.

A high-frequency current are supplied for exciting the foregoing antenna elements 13, 23 and 33. FIG. 2 shows an example where the current is supplied to first antenna element 13. At the "square C" shaped section which have been folded in plural times in intermediate section 13*b*, the currents flowing in right and left directions cancel each other out because they run opposite to each other, so that current "i13" and "i13" flowing at the upper section alone excite element 13. An image current corresponding to these currents "i13" and "i13" flows in ground plate 1 in phase with them.

A conventional antenna needs a height of 83 mm corresponding to 1/4 wavelength; however, antenna 3 in accordance with this embodiment has a height as low as 23 mm.

FIG. 3 shows characteristics of frequency-band of the antenna discussed above, and the characteristics show a test result of the antenna. As shown in FIG. 3, intervals provided between the respective dielectrics, namely, holders and a support, allow reducing an average dielectric constant as well as an average dielectric loss between each antenna element in the frequency band of PDC 800. As a result, this antenna can obtain approx. the same gain as an antenna in which an air-layer alone is available between respective antenna elements, and an operative antenna gain of not less than −3 dBi is obtainable.

This antenna is low-profiled to as low as 23 mm while conventional mono-pole antennas and folded mono-pole antennas need a height of 83 mm, so that the height of this antenna is reduced to almost ¼ of that of the conventional ones. As a result, antenna 3 can be mounted in a rear tray or in a dashboard of cars.

As discussed above, this exemplary embodiment proves that the intermediate section of an antenna element is folded into "square C" shape in plural times, so that the height of the antenna element is low-profiled for obtaining a compact antenna.

A parasitic antenna element is provided, and this element is excited in-phase with the first and the second antenna elements, thereby boosting the excitation. As a result, a frequency band of the antenna can be broadened.

In this embodiment, the respective holders and the support formed integrally with copper or ABS resin are used; however, the present invention is not limited to this structure. For instance, a substrate of copper-clad laminated printed wiring board made of epoxy resin or phenol resin can be used as holders or a support, and the copper foil of the copper-clad board is pattern-etched, thereby forming respective antenna elements. Instead of the copper-clad laminated printed wiring board, aluminum foil or silver foil may be used as the metal layer of the printed wiring board. As the patterning method, dry-etching or wet etching is available. As patterning metal by etching can provide highly precise patterning of metal conductor, this invention can provide a small antenna and a high precision antenna.

There is another method for making an antenna element on a dielectric substrate like epoxy resin. For example: (1) pattern-printing an adhesives in a pattern of antenna elements on a epoxy substrate, (2) sprinkling or spraying metal powders on the patterned adhesives, (3) curing the adhesives by heating, and (4) removing extra powders by solvents. Copper powder, silver powder or aluminum powder may be used in the step (2).

Figure 4:
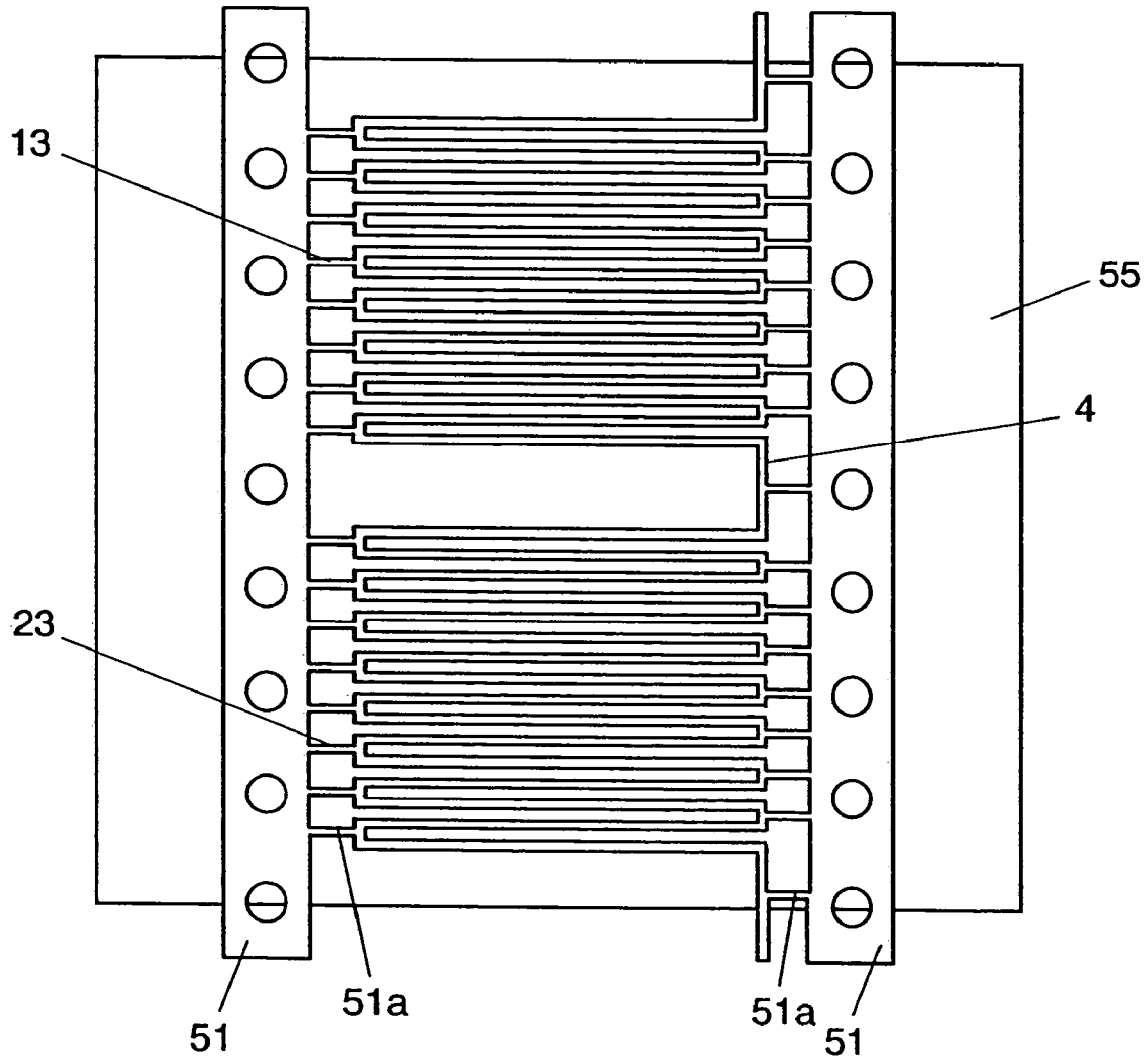
FIG. 4 shows a plan view of an antenna in accordance with another exemplary embodiment of the present invention.

Next, another antenna using a sheet as holders and a support is demonstrated hereinafter. As shown in FIG. 4, a metal plate such as a planar copper is pressed or etched to form first antenna element 13, second antenna element 23, and junction conductor 4 coupled respectively to hoop frame 51 with coupling sections 51*a*.

Figure 5:
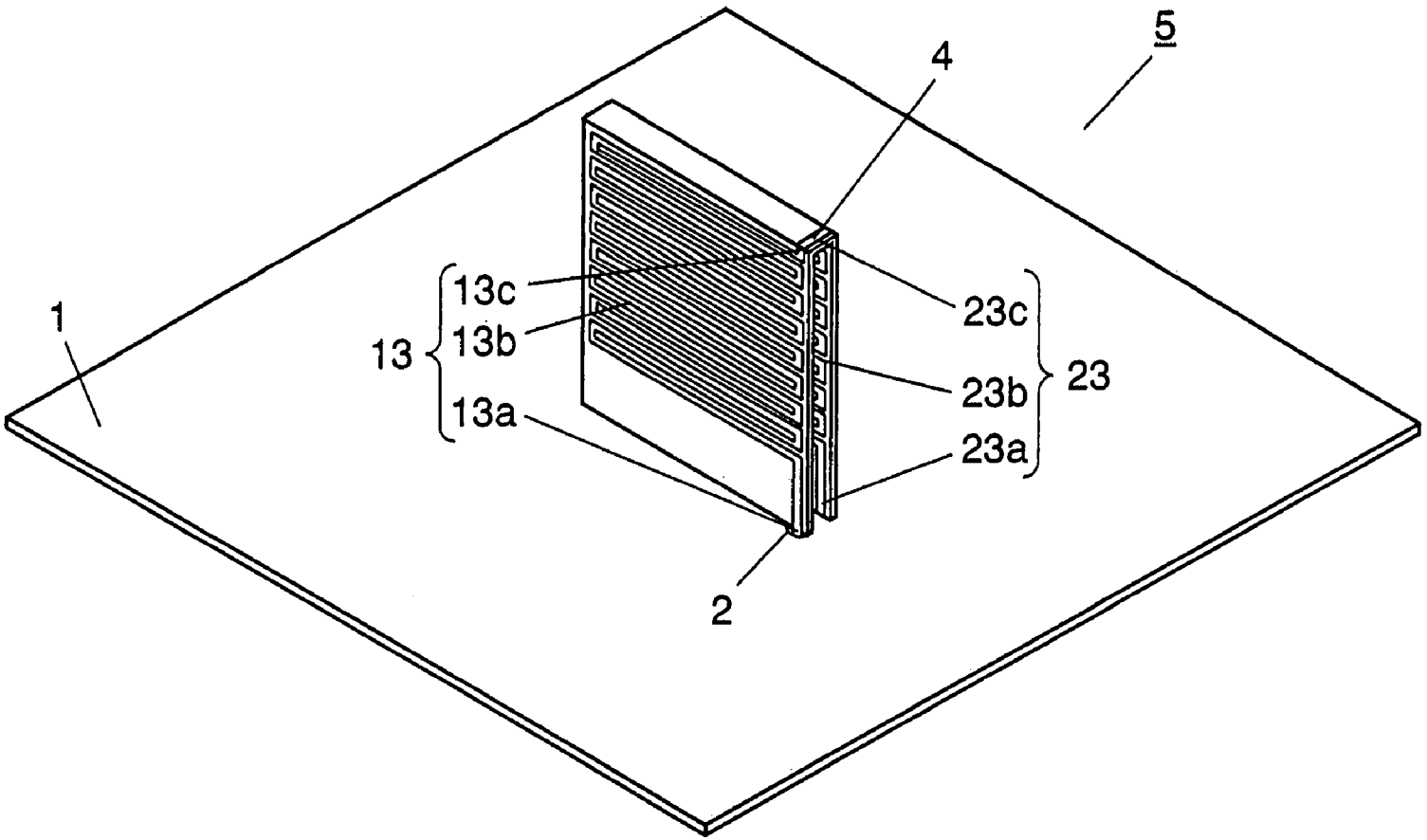
FIG. 5 shows a perspective view of an antenna in accordance with another exemplary embodiment of the present invention.
Figure 6A:
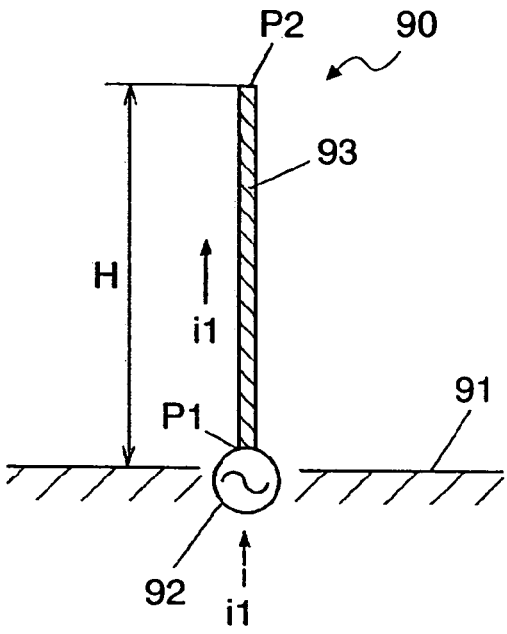
FIG. 6A and FIG. 6B show lateral views of a conventional antenna.
Figure 6B:
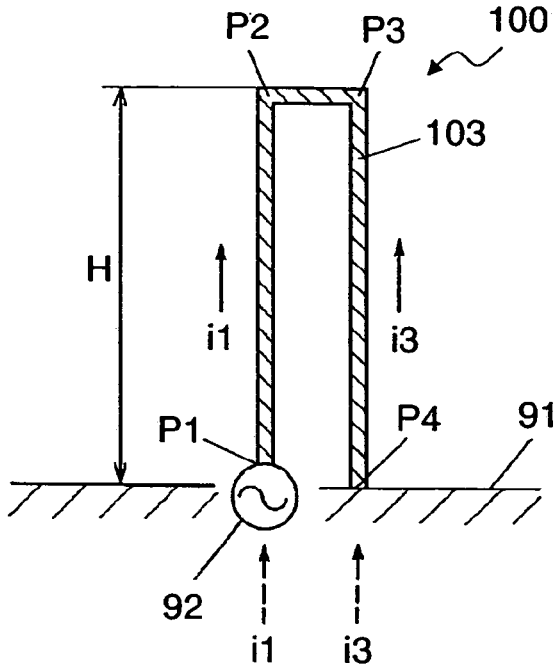

Then entire hoop frame 51 is laminated by sheet 55 made of resin to form a laminated body of antenna elements and the sheet. Coupling sections 51*a* laminated by sheet 55 are cut by pressing. The laminated body of first antenna element 13, second antenna element 23 and junction conductor 4 is unitarily bent, thereby forming antenna 5 with ease as shown in FIG. 5. It is preferable to heat the laminated body, depending on a kind of resin, up to a temperature around a softening point of the resin when the laminated body is bent.

It is preferable to use a sheet having a self-holding property in this embodiment, in other words, the sheet has a relevant thickness or width, and as shown in FIG. 5, the sheet having undergone the foregoing process can be held vertically with its shape being kept. The resin available for this sheet includes PET (polyethylene terephthalate), polyimide, PEN (polyethylene naphthalate), PVDC (poly-vinylidene chloride) and PEI (polyetherimide). Further, PC (polycarbonate) and PMMA (polymethylmethaclylate) can be also used. The width or thickness enough for maintaining self-holding property depends on a kind of resin. For instance, PMMA resin can exert its self-holding property with a thickness of 1 mm.

First antenna element 13 and second antenna element 23 are placed on the same face of sheet 55, and folded into "square C", so that element 13 is placed on this side and element 23 is placed on that side in FIG. 5. Antenna 5 works similar to what is discussed previously. (In actual, antenna element 23 behind cannot seen from the front; however, element 23 is drawn with solid lines in FIG. 5 for describing its shape.)

In the foregoing discussion, two holders and two antenna elements are placed on one sheet; however, the present invention is not limited to this construction. For instance, more than one pair of holders and one pair of antenna elements can be formed on one sheet.

In this embodiment, intermediate sections of first antenna element 13, second antenna element 23, and parasitic antenna element 33 are folded into "square C" shapes; however, the folded shape is not limited to "square C", and it can be a "letter V", a "letter U" or a spiral shape. As long as high-frequency currents flowing through the first, second and parasitic antenna elements shaped in one of the foregoing figures are excited in phase, the advantage similar to what is discussed previously is obtainable.

Intermediate sections of first antenna element 13, second antenna element 23, and parasitic antenna element 33 are not necessarily shaped in the same figure. For instance, an intermediate section of a first antenna element can be shaped in "square C" and that of a second antenna element can be shaped in "letter V" with an advantage similar to what is discussed previously.

INDUSTRIAL APPLICABILITY

The present invention allows low-profiling antenna elements, so that a compact antenna is obtainable. The antenna of the present invention is useful for mobile radio devices.

What is claimed is:

1. An antenna comprising:

(a) a conductive ground plate;

(b) a first holder provided to the ground plate vertically;

(c) a first antenna element formed on one of a front face and a rear face of the first holder, the first antenna element including:

(c-1) a first end coupled to a power feed point; and (c-2) an intermediate section formed above the ground plate and folded in plural times;

(d) a second holder provided to the ground plate vertically and confronting the first holder at a given interval;

(e) a second antenna element formed on one of a front face and a rear face of the second holder, the second antenna element including:

(e-1) a first end coupled to a second end of the first antenna element;

(e-2) an intermediate section formed above the ground plate and folded in plural times;

(e-3) a second end coupled to the ground plate, and (f) a parasitic antenna element including first and second ends, the first end being coupled to the ground plate and the second end being open circuited, the parasitic antenna extending along a plane at a given interval from one of the first or second holders, wherein the first holder and the second holder are dielectric substrates, and the first antenna element and the second antenna element are conductors patterned on the dielectric substrates.

2. The antenna of claim 1 further comprising:

(f) a support formed of a dielectric substrate, the support provided to the ground plate vertically and confronting one of the first holder and the second holder at the given interval;

wherein the parasitic antenna element further includes:

an intermediate section having a folded shape such that the parasitic antenna element is a conductor patterned on the dielectric substrate.

3. The antenna of claim 2, wherein the respective folded shapes of the first antenna element, the second antenna element and the parasitic antenna element are shaped like one of "square C", "letter V"and "letter U".

4. The antenna of claim 1, wherein the conductors are patterned on the dielectric substrates by etching.

5. The antenna of claim 1, wherein the conductors are patterned by etching a metal layer of a printed wiring board.

6. The antenna of claim 1, wherein the conductors are metal powders formed on patterned adhesives.

7. The antenna of claim 1, wherein the conductors are patterned metal unitarily molded with resin.

8. The antenna of claim 1, wherein the parasitic antenna element is excited in-phase with the first and second antenna elements.

* * * * *